United States Patent [19]

Wikström

[11] 4,204,572

[45] May 27, 1980

[54] DEVICES FOR CLEANING HEATING BATTERIES

[75] Inventor: Axel T. Wikström, Falkenberg, Sweden

[73] Assignee: AB Scandinavian Energy Saving Co., Halmstad, Sweden

[21] Appl. No.: 862,844

[22] Filed: Dec. 21, 1977

[30] Foreign Application Priority Data

Feb. 4, 1977 [SE] Sweden ..... 7701244

[51] Int. Cl.[2] ..... F28G 1/16

[52] U.S. Cl. ..... 165/95; 165/98

[58] Field of Search ..... 165/95, 98, 119, 96, 165/134, 174

[56] References Cited

U.S. PATENT DOCUMENTS

| | | | |
|---|---|---|---|
| 1,135,685 | 4/1915 | Gunn et al. | 165/96 |
| 1,367,031 | 2/1921 | Fedders | 165/98 |
| 2,288,598 | 7/1942 | Ramsaur | 165/174 |
| 4,067,384 | 1/1978 | Miyakawa | 165/172 |

FOREIGN PATENT DOCUMENTS

| | | | |
|---|---|---|---|
| 469213 | 11/1928 | Fed. Rep. of Germany | 165/134 |
| 853080 | 8/1952 | Fed. Rep. of Germany | 165/134 |
| 532557 | 2/1922 | France | 165/95 |

*Primary Examiner*—Sheldon Richter

*Attorney, Agent, or Firm*—Fitch, Even & Tabin

[57] ABSTRACT

In batteries of tubes conducting a heating fluid air is led through the spaces between the tubes, to be heated for use in grain drying installations or the like. Airborne dust and impurities form deposits on the tubes and impair heat transmission. The deposits are removed from the tubes by increasing at intervals the air velocity by means of a grid structure defining passages having a reduced flow area and placed in front of the interspaces between the tubes.

4 Claims, 2 Drawing Figures

DEVICES FOR CLEANING HEATING BATTERIES

The present invention relates to apparatus for cleaning heating batteries which are designed for the throughflow of air to be heated between tubes conducting a heating fluid.

In such heating batteries the velocity of the airflow is kept low when the air shall be heated to a high temperature. Dust and other impurities entrained with the air will settle on the tubes at the low air velocity, and this will reduce the heat exchange efficiency of the battery.

The removal of the dust deposits will require frequent cleaning of the tubes, e.g. blowing by air or rinsing by water. This is a tedious, time-consuming and costly procedure.

It is an object of the invention, therefore, to provide apparatus by which the cleaning of heating batteries can be carried out in a very simple and efficient manner, eliminating the need of the older non-satisfactory methods.

This object is attained by providing flow accelerating means which can selectively be located at and removed from the upstream side of the heating tubes, said flow accelerating means defining flow passages corresponding to the interspaces between the heating tubes and converging to a smaller throughflow area than said interspaces.

With this arrangement the velocity of the air flow will be raised to a level effective for cleaning the tubes when bringing the device in front of the tube battery.

Figure 1:
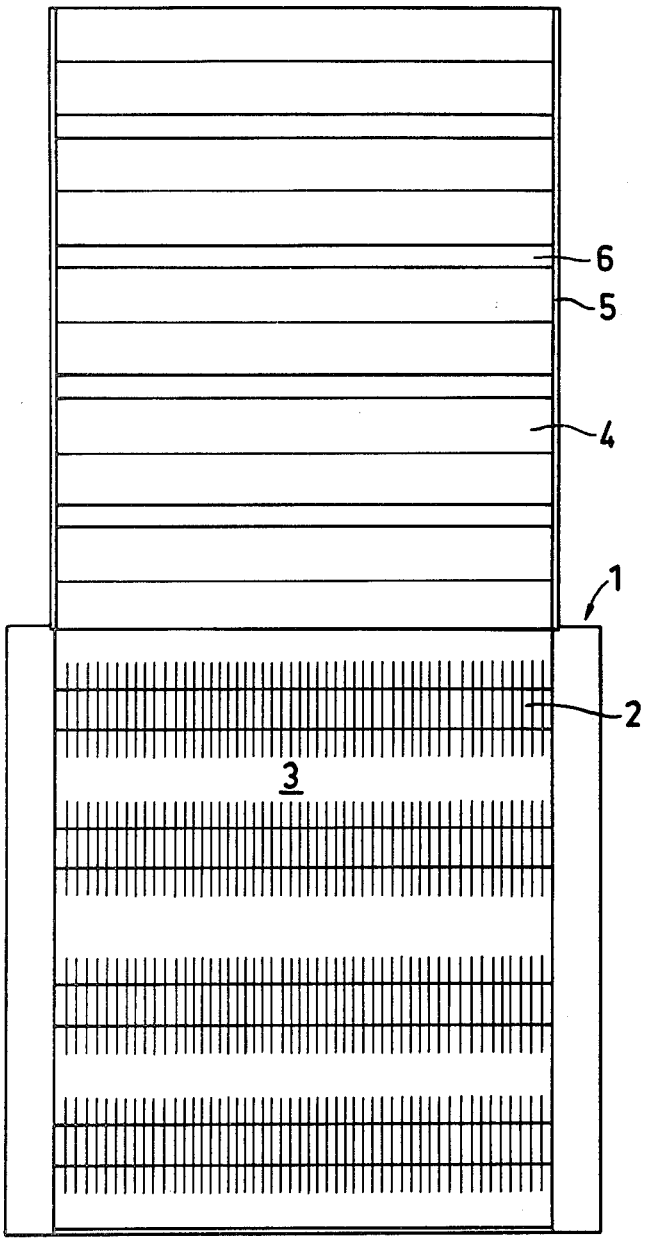
Figure 2:
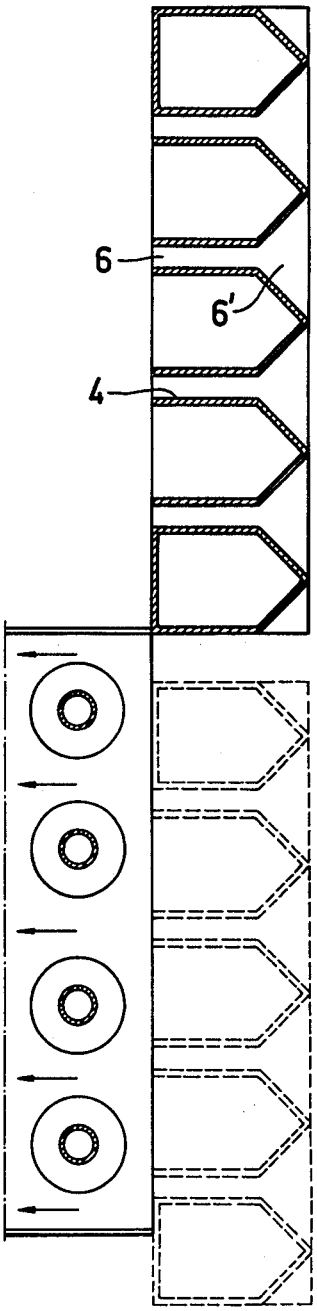

An embodiment of the invention which is particularly suited for use with grain drying installations will now be described, reference being had to the annexed drawing. In the drawing, FIG. 1 is a diagrammatical front elevation view and FIG. 2 a cross section view at right angles to FIG. 1 showing a cleaning device for use together with a heating battery comprising finned tubes.

In the drawing numeral 1 denotes a battery of finned tubes 2 for conducting a heating fluid therethrough. The battery may comprise one or more rows of tubes beyond the single row illustrated. Between the tubes 2 passages or spaces 3 are defined for the throughflow of air to be heated. The air is aspired through these interspaces by non-illustrated fan means of any known or suitable type. Dust and other impurities suspended in the air will form deposits on the tubes 2 at the low airflow velocity maintained for heating the air to the desired temperature. The deposits will act as an obstruction to the transmission of heat and will thus impair the heating efficiency. In order to increase the air flow velocity between the tubes to perform a scavenging action and the removal of the deposits from the tubes without the need of providing fans having a large reserve of power the invention provides means for accelerating the air flow and thus increasing its velocity before its passage between the finned tubes, by means of a special choking device. This device comprises an assembly of choking members 4 connected by side members 5 and being of dimensions and spacing substantially corresponding to that of the tubes 2. Between the choking members 4 flow passages 6 are defined having an area susceptible to raise the velocity of the air flow passing between the tubes 2 of the battery to a magnitude sufficient for cleaning, this area being substantially smaller than the free through-flow area between the tubes. The device can be moved from an inactive position, for example an elevated position as illustrated in the drawing, into a position facing the tubes as shown with dash lines in FIG. 2. In the lastmentioned position the air is conducted in the first place through the passages 6 and will be accelerated thereby to a greater velocity corresponding to the reduced throughflow area before it sweeps over the tubes 2. The swift air flow will remove the deposits formed at the tubes by air having flown through at normal operation velocity.

In order to keep down flow losses and turbulence of the air passing through the choking device the latter is formed with convergent inlet sections 6' which are continued by the passages 6. The choking elements 4 are preferably formed of profiled tubes or of sheet metal profiles bent to a corresponding cross section shape. The frame and grid structure formed of elements 4 and the side members 5 is joined together for example by welding.

The device 4, 5 can be arranged for being raised and lowered, for example by a mechanism operated by an electric motor. This mechanism can be actuated according to a programme, to move the device into or away from its operative position with predetermined intervals.

Beyond the advantageous effects attained with the invention such as cleaning easily performed and maintaining the efficiency of heating batteries there will also be a substantial saving of energy since the heating assemblies and other parts of an installation may remain at operational temperature all the time and need not be shut down for cleaning which would be conducive to their cooling and the need of reheating.

What I claim is:

1. In a device for cleaning a heating battery comprising a multitude of spaced tubes assembled in generally parallel relationship and conducting therethrough a heating fluid for the exchange of heat with a gaseous flow in a transverse direction to said tubes and through the interspaces between adjacent tubes, the provision of flow accelerating channel means having a relatively larger inlet area and a passage area decreasing to a minimum downstream of said inlet area, said channel means capable of being selectively brought into a position of registering with said tube interspaces upstream of said heating battery and close thereto, and away from such position, respectively, said minimum passage area being smaller than said interspaces so as to increase the velocity of any given gaseous flow between said tubes.

2. A device according to claim 1 for use with a heating battery comprising parallel finned tubes wherein said channel means comprise a group of spaced parallel guide members for the gaseous flow defining gas passages therebetween.

3. A device according to claim 2 wherein said guide members are formed of sheet metal elements shaped into a cross-section having an increasing area in the air flow direction.

4. In combination with a heating battery formed of spaced horizontal finned tubes the provision of a device according to claim 3 wherein said sheet metal members form together with lateral connecting members an assembly capable of being selectively raised and lowered between an operative and an inoperative position, respectively, in front of said heating battery.

* * * * *

UNITED STATES PATENT AND TRADEMARK OFFICE

CERTIFICATE OF CORRECTION

PATENT NO. : 4,204,572

DATED : May 27, 1980

INVENTOR(S) : Axel T. Wikstrom

It is certified that error appears in the above-identified patent and that said Letters Patent are hereby corrected as shown below:

Column 2, line 63, "Claim 8" should read --Claim 3--.

Signed and Sealed this

*Fifth* Day of *August 1980*

[SEAL]

*Attest:*

SIDNEY A. DIAMOND

*Attesting Officer*

*Commissioner of Patents and Trademarks*